US011519610B2

(12) United States Patent
Johnson et al.

(10) Patent No.: US 11,519,610 B2
(45) Date of Patent: Dec. 6, 2022

(54) SEALING TEMPERATURE SENSOR ASSEMBLY FOR AN APPLIANCE COOKTOP

(71) Applicant: Haier US Appliance Solutions, Inc., Wilmington, DE (US)

(72) Inventors: Eric Scott Johnson, Louisville, KY (US); Kyle Andrew Kozinski, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 655 days.

(21) Appl. No.: 16/509,634

(22) Filed: Jul. 12, 2019

(65) Prior Publication Data

US 2021/0010677 A1 Jan. 14, 2021

(51) Int. Cl.

| | |
|---|---|
| ***F24C 7/08*** | (2006.01) |
| ***F24C 15/10*** | (2006.01) |
| ***F24C 3/12*** | (2006.01) |
| ***H05B 6/06*** | (2006.01) |
| ***H05B 3/74*** | (2006.01) |

(52) U.S. Cl.

CPC ..... *F24C 7/083* (2013.01); *F24C 3/126* (2013.01); *F24C 15/10* (2013.01); *H05B 3/746* (2013.01); *H05B 6/062* (2013.01); *H05B 2213/07* (2013.01)

(58) Field of Classification Search

CPC ..... F24C 15/105

See application file for complete search history.

(56) References Cited

U.S. PATENT DOCUMENTS

| | | | | |
|---|---|---|---|---|
| 9,696,039 | B2 * | 7/2017 | Cadima | F23D 14/065 |
| 10,582,573 | B2 * | 3/2020 | Hoare | F24C 15/105 |
| 2017/0142780 | A1 | 5/2017 | Hoare et al. | |

FOREIGN PATENT DOCUMENTS

| | | | | |
|---|---|---|---|---|
| CN | 207132397 | U | | 3/2018 |
| JP | 09180873 | A | * | 7/1997 |
| JP | 09213469 | A | * | 8/1997 |
| JP | 3019304 | B2 | | 3/2000 |
| WO | WO2018188573 | A1 | | 10/2018 |

* cited by examiner

*Primary Examiner* — Jorge A Pereiro

(74) *Attorney, Agent, or Firm* — Dority & Manning, P.A.

(57) ABSTRACT

A temperature sensor assembly for a cooktop appliance can include a plate with a cylindrically-shaped boss, one or more seals located in one or more grooves of the plate, a grommet disk engaged with the bottom surface of the plate, and a cylindrically-shaped grommet in which a cap for a temperature sensor is positioned and is slidable therein.

19 Claims, 7 Drawing Sheets

SEALING TEMPERATURE SENSOR ASSEMBLY FOR AN APPLIANCE COOKTOP

FIELD OF THE INVENTION

The present subject matter relates generally to a sealing temperature sensor assembly for an appliance cooktop.

BACKGROUND OF THE INVENTION

Certain appliances include a cooktop surface for applying heat energy to utensils containing one or more food items for purposes of cooking. One or more heating elements (e.g., electric or gas fuel based) may be positioned at the surface with individual controls for determining the amount of heat applied. A user may control the amount of heat energy according to predetermined settings such as low, medium, or high. The user may also rely on visual observations of the food during cooking to determine e.g., whether the amount of heat energy being applied should be adjusted.

Typically, cooktop appliances have not included sensors for measuring the temperature of the food and/or utensils on the cooktop even though such would be useful for cooking operations. Aside from adding to the cost of the cooktop appliance, the addition of temperature sensors presents certain challenges. For example, the temperature sensor must also be able to withstand the heat of the cooking process while reliably measuring temperature. Components used to position the temperature sensor must also be able to reliably withstand temperatures of the cooking process. The sensor and related components must also be protected against liquids (e.g. water, oil, etc.). Accurate temperature measurement may require a dedicated temperature sensor at each location where a utensil will be placed—e.g., each heating element location.

Some cooktop appliances employ a cooktop surface constructed of e.g., glass that has heating elements positioned within the glass or just beneath the cooktop surface provided by the glass. For example, some cooktop appliances may rely on induction-based heating elements that act upon the metal of the utensil to heat food items. The induction-based elements can be positioned directly within or beneath the cook-top surface. In another example, resistance-based heating elements such as electric coils may be used in similar constructions.

In such cooktop constructions, in order to measure temperature of the cooking utensil containing food items, it is desirable to provide for placement of the temperature sensor in direct contact with, or in close proximity to, the utensil in order to obtain more accurate temperature information. At the same time, it would be beneficial to protect the temperature sensor from damage such as might be caused by heat and spills during the cooking process. A temperature sensor assembly for an appliance cooktop providing for one or more of these and other advantageous features would be useful.

BRIEF DESCRIPTION OF THE INVENTION

In one exemplary embodiment, the present invention provides a sealing temperature sensor assembly for a cooktop appliance. This exemplary temperature sensor assembly defines a vertical axis and includes a plate defining a top surface and a bottom surface. The plate defines a first annular groove positioned on the top surface of the plate and facing upwardly along the vertical axis. A cylindrically-shaped boss may protrude upwardly along the vertical axis from the top surface of the plate. The boss defines a centrally-located aperture extending though the plate. A first seal is located in the first annular groove of the plate.

A grommet disk defines a top surface and a bottom surface with the top surface of the grommet disk engaged with the bottom surface of the plate. The grommet disk defines a cylindrically-shaped grommet extending along the vertical axis from the grommet disk and may extend into the centrally-located aperture of the boss. The cylindrically-shaped grommet has a grommet opening. A cap for a temperature sensor can be positioned within the grommet opening. The cap can be movable or slidable along the vertical axis within the grommet opening. The cap may define an interior space for receipt of a temperature sensor.

The boss may define a second annular groove on a radially outward surface of the boss. The second annular groove can face radially outward from the vertical axis. A second seal can be located in the second annular groove.

The first annular groove may have a first annular groove diameter while the second annular groove may have a second annular groove diameter. The first annular groove diameter may be greater than the second annular groove diameter.

In another exemplary embodiment, the present invention provides an appliance having a cooktop. The appliance can include a glass cooktop surface defining a cooktop surface opening. A heating element may be positioned at the cooktop surface adjacent to the cooktop surface opening. A plate defines a top surface and a bottom surface. The plate defines a first annular groove positioned on the top surface of the plate and faces upwardly along a vertical axis. The cooktop may include a cylindrically-shaped boss protruding upwardly along the vertical axis from the top surface of the plate. The boss may define a centrally-located aperture extending though the plate. A first seal can be located in the first annular groove of the plate.

For this exemplary embodiment, a grommet disk defines a top surface and a bottom surface. The top surface of the grommet disk engages with the bottom surface of the plate. The grommet disk defines a cylindrically-shaped grommet extending along the vertical axis from the grommet disk, may extend through the centrally-located aperture of the boss, and into the cooktop surface opening. The cylindrically-shaped grommet has a grommet opening. A cap can be provided for a temperature sensor. The cap is positioned within the grommet opening. The cap is slidable along the vertical axis within the grommet opening. The cap defines an interior space for receipt of a temperature sensor. The boss may extend into the cooktop surface opening and define a second annular groove on a radially outward surface of the boss. The second annular groove can face radially outward from the vertical axis. A second seal can be located in the second annular groove with the second seal contacting the glass cooktop surface at the opening.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
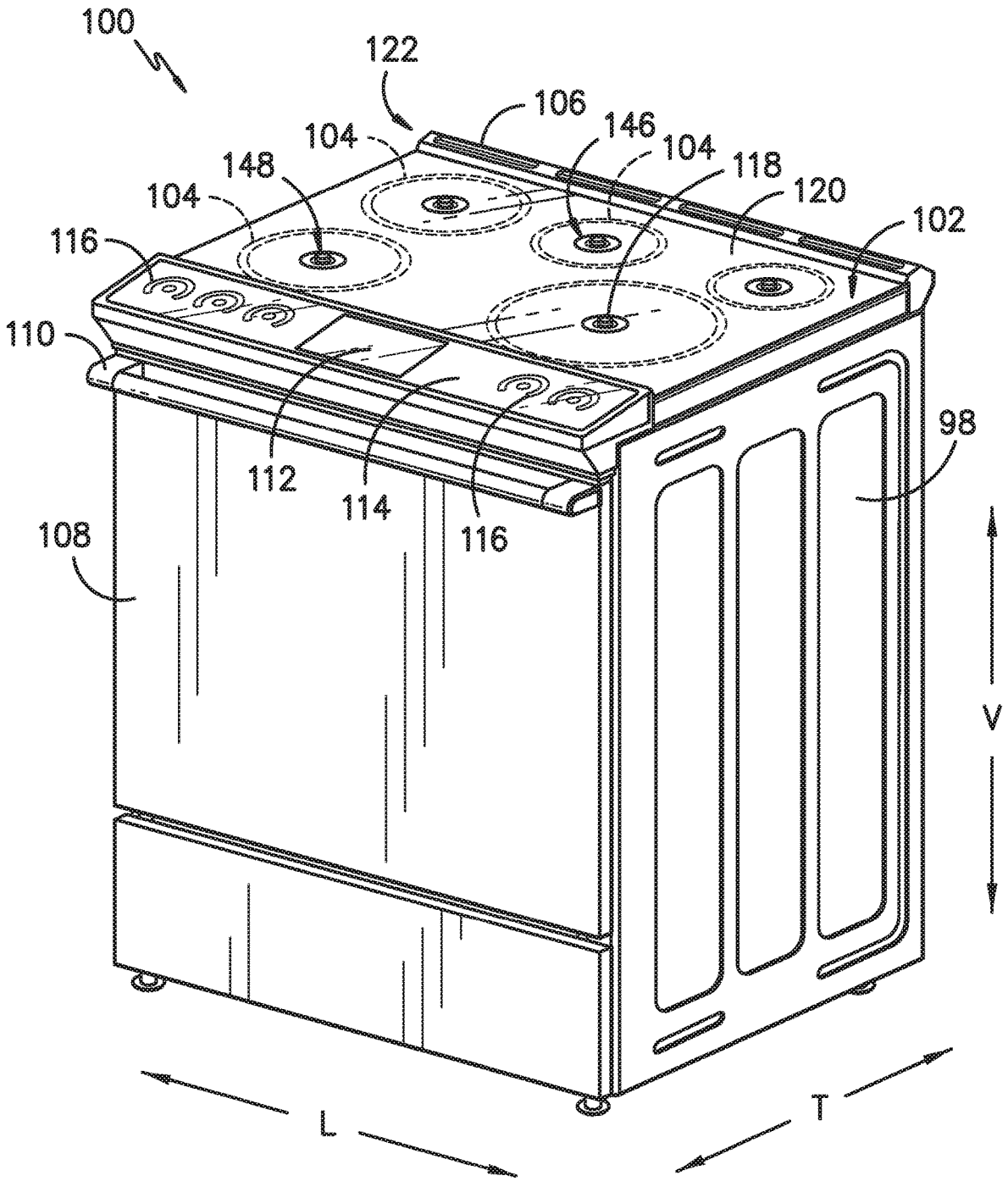
FIG. 1 provides a perspective view of an exemplary embodiment of an appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a cooking appliance 100 according to an exemplary embodiment of the present invention. Appliance 100 defines a vertical direction V, lateral direction L, and transverse direction T forming an orthogonal coordinate system that may be used for reference herein.

Figure 7:
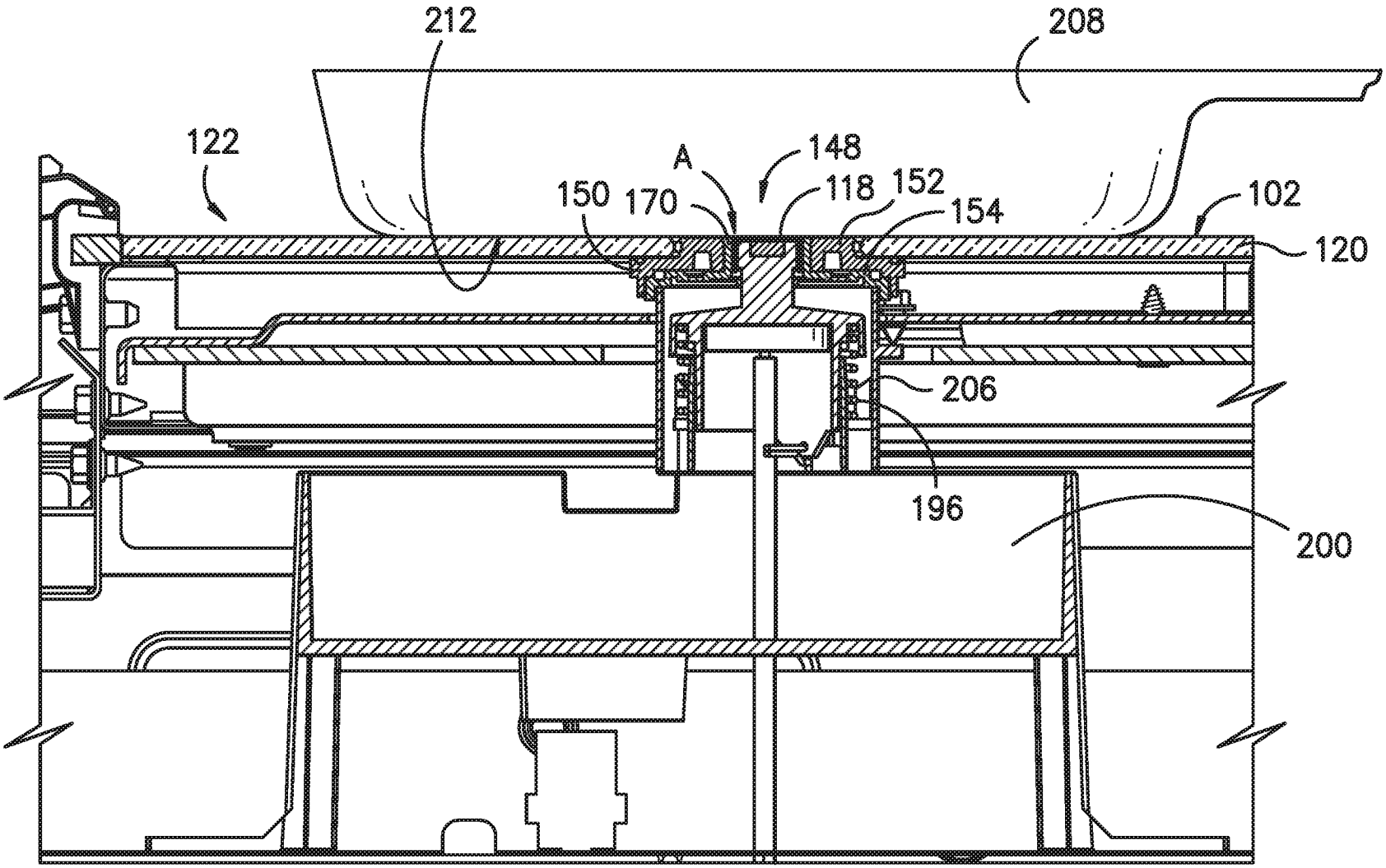
FIG. 7 is a cross-sectional view of the exemplary assembly of FIG. 3 in the contact of an exemplary appliance with a cooktop.

Appliance 100 includes a cooktop 122 having a cooktop surface 102 supported by a cabinet 98. Cooktop surface 102 includes a plurality of heating elements 104 and an adjacent ventilation 106. Heating elements 104 may be e.g., inductive or resistance-based heating elements positioned below or within a panel 120 providing cooktop surface 102. Panel 120 may be constructed of e.g., glass. While shown with five heating elements 104 in the exemplary embodiment of FIG. 1, cooktop appliance 100 may include any number of such elements, which may be different in size, arrangement, and appearance from what is shown in FIG. 1. By way of example, utensils containing food items may be placed on one or more heating elements 104 during cooking operations as shown in FIG. 7.

Continuing with FIG. 1, for this particular embodiment, cooking appliance 100 includes an oven having an oven cavity in cabinet 98 that may be accessed by the opening and closing of door 108 using handle 110. Food items can be placed directly into the oven cavity for cooking operations such as broiling or baking. Appliance 100 can be e.g., free-standing or could be built into the cabinetry of a user's kitchen. However, the present invention is not limited to the appliance 100 shown in FIG. 1 or to an appliance having an oven. For example, in other exemplary embodiments, the present invention includes an appliance cooktop without an oven or cabinet 98—such as an appliance that only includes cooktop 122. In such embodiments, the cooktop appliance could be e.g., built directly into the cabinetry of a user's kitchen. One of skill in the art, using the teachings disclosed herein, will understand that other embodiments of the present invention may be configured as well.

Appliance 100 includes a user interface panel or control console 114. A graphical display 112 may be included to provide the user with certain features such as a clock, timer, settings, and/or other information that may be helpful to cooking operations. Features for controlling the oven may also be included. Console 114 also includes a plurality of heating element controls 116. Each control 116 is associated with one of the heating elements 104 and may be used e.g., to determine the setting or heat energy provided by an associated heating element 104. In FIG. 1, controls 116 are depicted as touch-sensitive type controls. However, other controls using e.g., knobs, buttons, or other types of switches may also be used.

Figure 2:
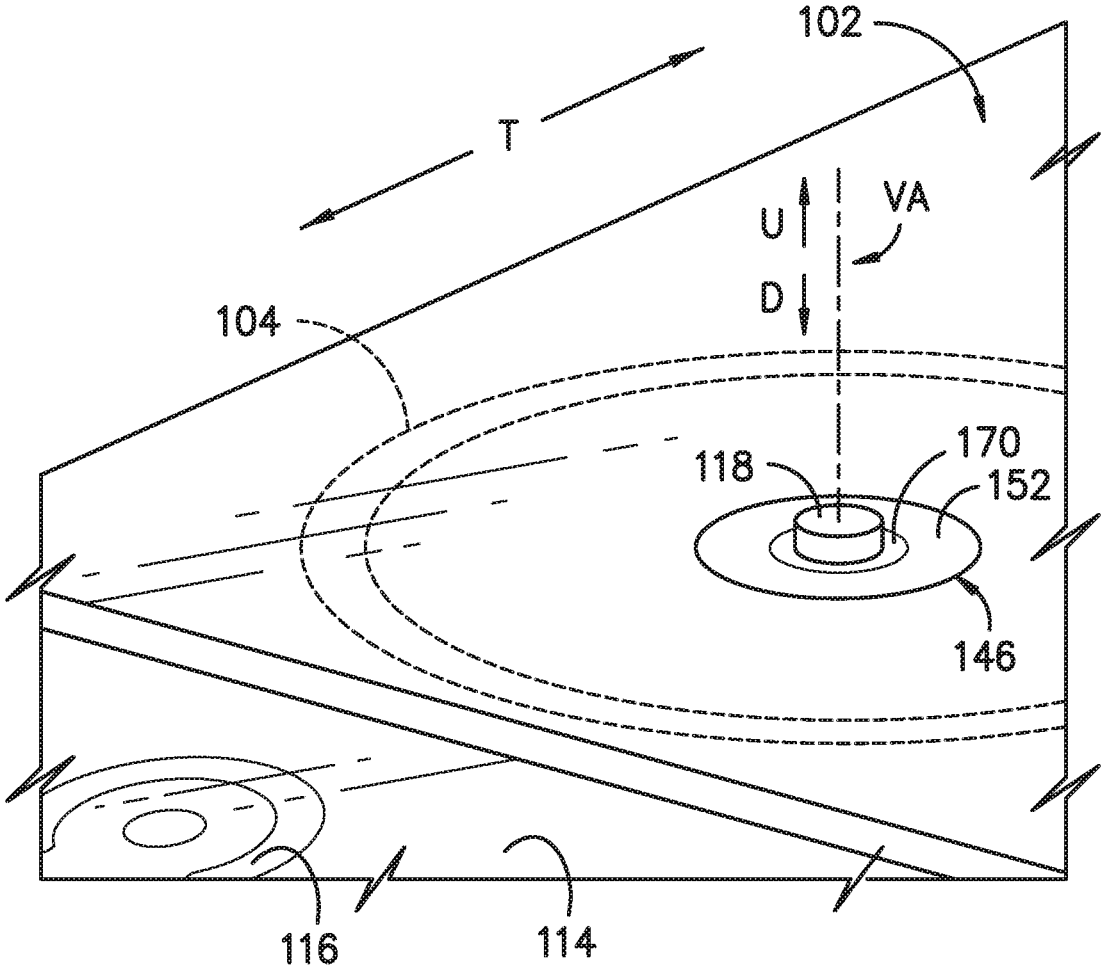
FIG. 2 is a close-up, perspective view of a portion of the cooktop of the exemplary appliance of FIG. 1.
Figure 3:
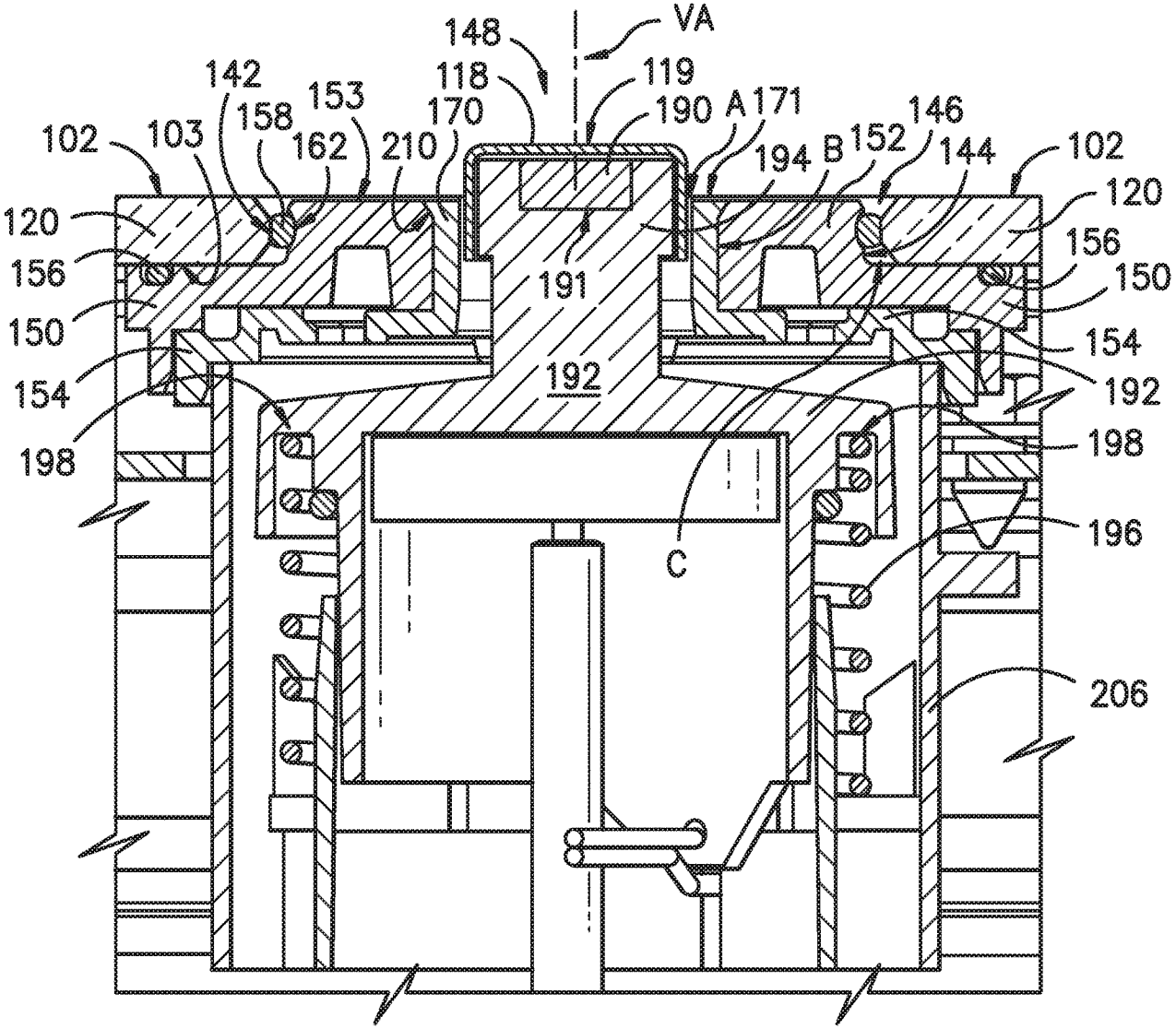
FIG. 3 is a cross-sectional view of an exemplary sealing temperature sensor assembly of the present invention.

As shown in FIGS. 1, 2, and 3 a cap 118 from a sealed temperature sensor assembly 148 (FIG. 3) extends through an opening 146 in the cooktop panel 120 and cooktop surface 102. Cap 118 is movable or slidable in the up (arrow U) or down (arrow D) directions along a vertical axis VA. A biasing element such as a spring urges cap 118 into the position shown in FIGS. 1, 2, and 3. When e.g., a cooking utensil is placed onto cooktop surface 102, the weight of the cooking utensil and any food items contained therein will press cap 118 down D so that the top surface 119 of cap 118 is more or less flush with cooktop surface 102 (as depicted in FIG. 7). Cap 118 is thereby maintained in direct contact with the cooking utensil for purposes of improved temperature measurement as will be more fully described. While appliance 100 is shown with a sealed temperature sensor assembly 148 for each heating element 104, it should be understood that one or more elements 104 could be equipped instead of all in other embodiments.

Figure 4:
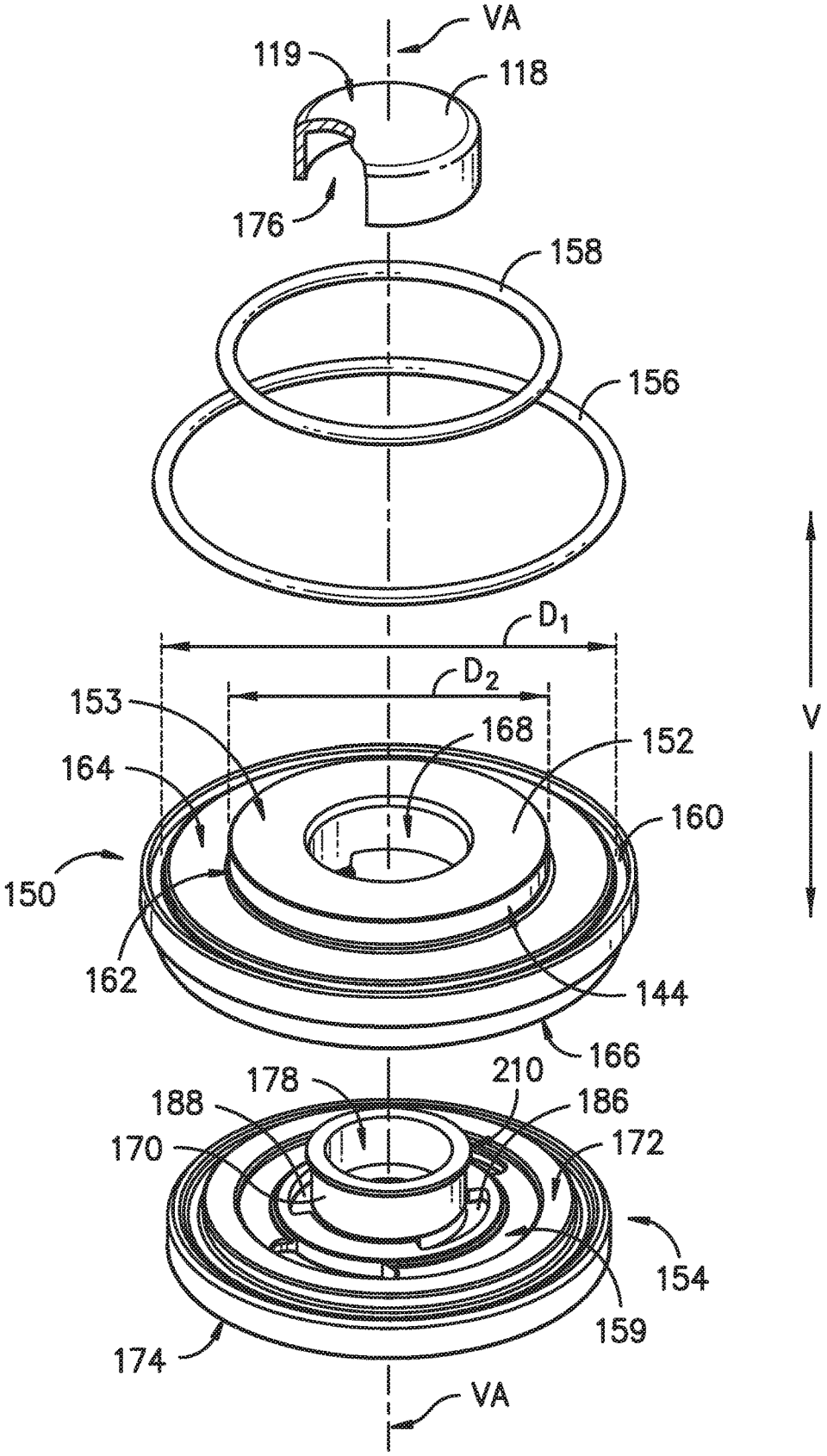
FIG. 4 is an exploded view of certain components of the exemplary sealing temperature sensor assembly of FIG. 3.

Referring to FIGS. 3 through 6, for this exemplary embodiment, sealed temperature assembly 148 includes a plate 150 defining a top surface 164 and a bottom surface 166 (FIG. 4). Plate 150 is circular in shape and includes a first annular groove 160 defined by top surface 164. First annular groove 160 faces upwardly along vertical axis VA and is configured to receive a first seal 156 that is pressed against a bottom surface 103 of cooktop panel 120 to provide a liquid seal as described more fully herein.

A cylindrically-shaped boss 152 protrudes upwardly along vertical axis VA from top surface 164 of plate 150. For this exemplary embodiment, boss 152 extends into the cooktop surface opening 146 and provides an upper contact surface 153 that can be e.g., flush with, or slightly below, cooktop surface 102. Boss 152 defines a centrally-located aperture 168 (FIG. 4) that extends through plate 150 along vertical axis VA.

Sealed temperature assembly 148 also includes a grommet disk 154 defining a top surface 172 and a bottom surface 174. Top surface 172 is engaged with bottom surface 166 of plate 150. Grommet disk 154 defines a cylindrically-shaped grommet 170 extending upwardly along vertical axis VA, into the centrally-located aperture 168 of boss 152, and into cooktop surface opening 146. As with boss 152, grommet 170 provides an upper contact surface 171 that can be e.g., flush with, or slightly below, cooktop surface 102. For this exemplary embodiment, the temperature sensor cap 118 contacts cookware (e.g., cooking utensil 208 in FIG. 7) whereas surfaces 153 and 171 do not contact cooking utensils during cooking operations. Near contact surface 171, grommet 170 includes a frustoconically-shaped lip 210 extending radially outward from grommet 170. As best viewed in FIG. 3, lip 210 helps grommet 170 engage boss 152 at contact surface 153. As used herein, the radial direction is defined by a radius extending orthogonally to the vertical axis VA.

Grommet 170 includes a grommet opening 178. Cap 118 is located within opening 178 and is movable or slidable therein along vertical axis VA. Grommet disk 154 may be constructed from a variety of materials. In one exemplary embodiment, grommet disk 154 is constructed from resilient material capable of withstanding the temperatures of cooking operations on appliance 100. For example, grommet disk 154 may be constructed from polyphenylene sulfide plastic.

Boss 152 also defines a second annular groove 162 located on radially outward surface 144. A second seal 158 is located in second annular grove 162 and contacts an annular surface 142 (FIG. 3) of opening 146 in cooktop panel 120. As shown in FIG. 4, first annular groove 160 has a first annular groove diameter $D_1$ that is greater than the second annular groove diameter $D_2$ of second annular groove 162. Seals 156 and 158 may be constructed form a variety of materials and may have a different shape or appearance from that shown in the figures. For example, seals 156 and 158 may be constructed from o-rings made from resilient materials capable of providing a liquid seal and withstanding the temperatures of cooking operations.

Figure 5:
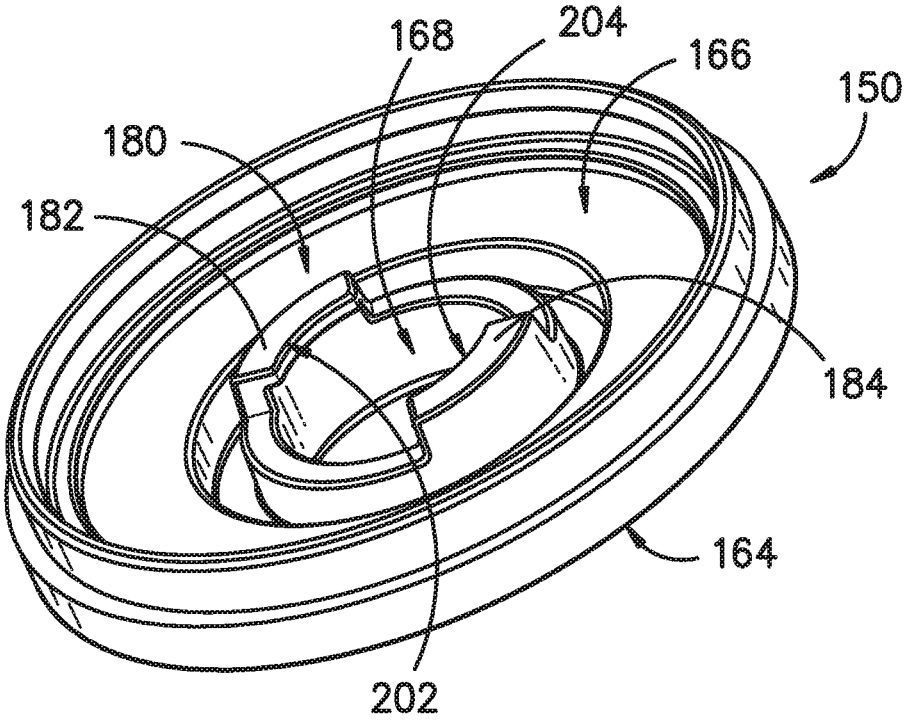
FIG. 5 is a perspective view of the bottom of an exemplary plate.
Figure 6:
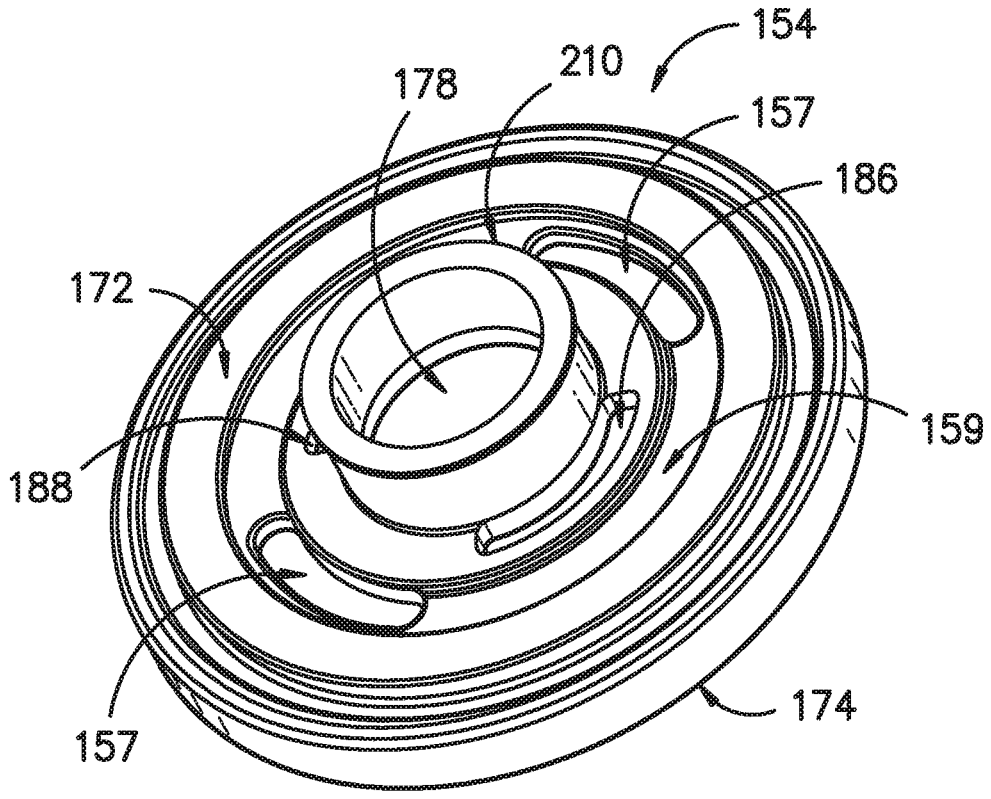
FIG. 6 is a perspective view of the top of an exemplary plate.

Referring to FIGS. 5 and 6, an interlock 180 is provided for securing plate 150 and grommet disk 154. For this exemplary embodiment, interlock 180 includes a pair of flanges 182 and 184 that extend downwardly along vertical axis VA. Flanges 182 and 184 are received into slots or apertures 186 and 188, respectively. Fingers 202 and 204 (FIG. 5) extend radially inward from flanges 182 and 184, respectively, towards vertical axis VA. Fingers 202 and 204 help secure plate 150 to grommet disk 154.

A temperature sensor 190 (FIG. 3) is positioned within cap 118. Temperature sensor 190 may be constructed from e.g., a thermocouple, thermopile, resistance temperature detector, or other constructions. For this exemplary embodiment, sensor 190 is located within a recess 191 at the end of a shaft 194 of piston 192. Removably received within cylinder 206, piston 192 is movable up (arrow U) and down (arrow D) along vertical axis VA. A biasing element or coil spring 196 is received into a third annular groove 198 formed by piston 192. Spring 196 urges piston 192 upwardly along vertical axis VA such that shaft 194 urges cap 118 upwardly as previously described.

Referring to FIG. 7, during cooking operations, the weight of utensil 208 (and any food items therein) depresses cap 118 downwardly along vertical axis VA while maintaining contact between its top surface 119 and the bottom surface 212 of utensil 208. Such contact helps ensure more accurate heat conduction and, therefore, temperature measurement by temperature sensor 190. At the same time, assembly 148 also helps protect appliance 100 from e.g., liquids that may be spilled onto cooktop surface 102 during cooking operations.

More particularly, in absence of sealed temperature sensor assembly 148, liquids deposited or spilled onto cooktop surface 102 might undesirably leak through cooktop surface opening 146 and onto other components of appliance 100. As such, assembly 148 provides seals 156 and 158 to control the movement of fluid between plate 150 and cooktop panel 120. Liquids that do not evaporate are routed along one of three pathways A, B, or C as depicted in FIG. 3. Liquids moving along pathway A will pass along piston 192, remain within the housing or cylinder 206 of assembly 148, and are collected in tray 200. Liquids passing along pathway B will travel through drain holes 157 in grommet disk 154 and into tray 200. A channel or groove (FIG. 4 and FIG. 6) helps route liquids to a pair of drain holes 157. Liquids in pathway C will be contained by one or more of seals 156 and 158.

Figure 8:
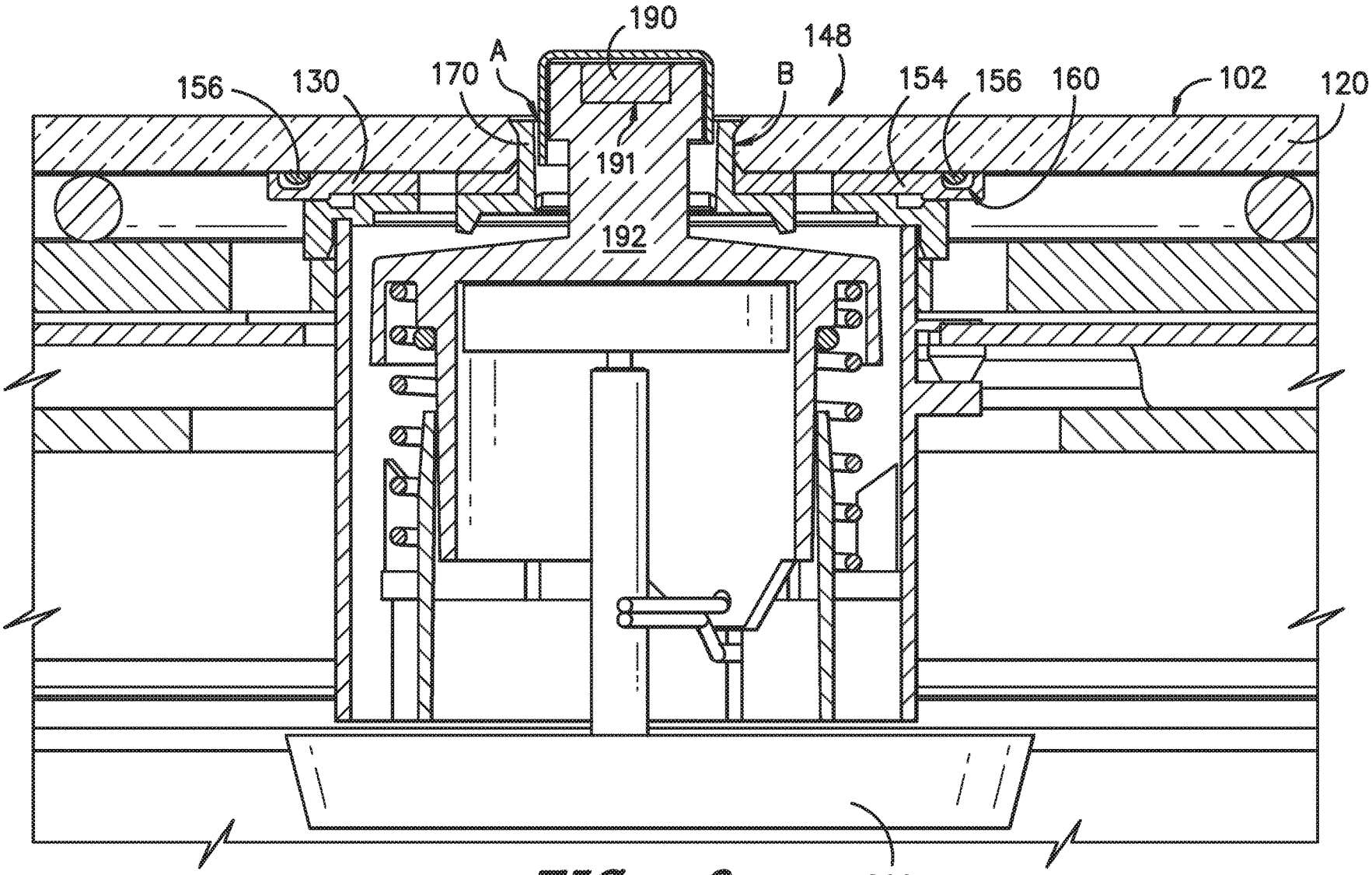
FIG. 8 is a cross-sectional view of another exemplary sealing temperature sensor assembly of the present invention.

FIG. 8 provides a cross-sectional view of another exemplary embodiment of sealed temperature assembly 148. For this embodiment, plate 150 lacks boss 152 and does not protrude through cooktop surface opening 146. Grommet 170 of grommet disk 154 protrudes through opening 146 and includes movable cap 118 as previously described. Plate includes first annular groove 160 with first seal 156 but does not include second seal 158. Liquids travelling along pathways A and B are controlled as previously described. Unlike the embodiment of FIGS. 1 through 7, assembly 148 of FIG. 8 does not include a boss 152 extending into cooktop surface opening 146. As such, the embodiment of FIG. 8 provides a different construction and appearance, which may be preferable for certain embodiments.

Although the invention has been discussed in the foregoing with reference to exemplary embodiments of a system and method according to the invention, the invention is not restricted thereto, and the system and method can be varied in many ways without departing from the invention. The discussed exemplary embodiments shall therefore not be used to construe the appended claims strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these exemplary embodiments.

What is claimed is:

1. A temperature sensor assembly for a cooktop appliance, the temperature sensor assembling defining a vertical axis, comprising:

a plate defining a top surface and a bottom surface, the plate defining a first annular groove positioned on the top surface of the plate and facing upwardly along the vertical axis, the plate further comprising a cylindrically-shaped boss protruding upwardly along the vertical axis from the top surface of the plate and defining a centrally-located aperture extending through the plate;

a first seal located in the first annular groove of the plate;

a grommet disk defining a top surface and a bottom surface, the top surface of the grommet disk engaged with the bottom surface of the plate, the grommet disk defining a cylindrically-shaped grommet extending along the vertical axis from the grommet disk and into the centrally-located aperture of the boss such that a pathway is defined between the cylindrically-shaped grommet and the cylindrically-shaped boss, and wherein the cylindrically-shaped grommet has a grommet opening; and a cap for a temperature sensor, the cap positioned within the grommet opening, the cap slidable along the vertical axis within the grommet opening, the cap defining an interior space for receipt of a temperature sensor.

2. The temperature sensor for a cooktop appliance as in claim 1, wherein the boss defines a second annular groove on a radially outward surface of the boss, the second annular groove facing radially outward from the vertical axis, and further comprising a second seal located in the second annular groove.

3. The temperature sensor for a cooktop appliance as in claim 2, wherein the first annular groove has a first annular groove diameter, the second annular groove has a second annular groove diameter, and the first annular groove diameter is greater than the second annular groove diameter.

4. The temperature sensor for a cooktop appliance as in claim 1, further comprising an interlock extending between the plate and the grommet disk that is configured for securing the plate and the grommet disk together.

5. The temperature sensor for a cooktop appliance as in claim 4 wherein the interlock comprises a pair of flanges extending downwardly along the vertical axis from the bottom surface of the plate towards the grommet disk.

6. The temperature sensor for a cooktop appliance as in claim 5, wherein the grommet disk defines a pair of apertures for receipt of the pair of flanges.

7. The temperature sensor for a cooktop appliance as in claim 1, further comprising a temperature sensor positioned within the cap.

8. The temperature sensor for a cooktop appliance as in claim 1, wherein the grommet comprises a flexible material.

9. The temperature sensor for a cooktop appliance as in claim 1, further comprising:

a piston having a shaft extending along the vertical axis and into the cap; and a spring that urges the piston upwardly along the vertical axis and against the cap.

10. The temperature sensor for a cooktop appliance as in claim 9, wherein the piston comprises a third annular groove for receipt of the spring.

11. A temperature sensor assembly for a cooktop appliance, the temperature sensor assembling defining a vertical axis, comprising:

a plate defining a top surface and a bottom surface, the plate defining a first annular groove positioned on the top surface of the plate and facing upwardly along the vertical axis, the plate further comprising a cylindrically-shaped boss protruding upwardly along the vertical axis from the top surface of the plate and defining a centrally-located aperture extending through the plate;

a first seal located in the first annular groove of the plate;

a grommet disk defining a top surface and a bottom surface, the top surface of the grommet disk engaged with the bottom surface of the plate, the grommet disk defining a cylindrically-shaped grommet extending along the vertical axis from the grommet disk and into the centrally-located aperture of the boss, the cylindrically-shaped grommet having a grommet opening;

a cap for a temperature sensor, the cap positioned within the grommet opening, the cap slidable along the vertical axis within the grommet opening, the cap defining an interior space for receipt of a temperature sensor;

a piston having a shaft extending along the vertical axis and into the cap, wherein the piston comprises a third annular groove; and a spring received within the third annular groove, wherein the spring urges the piston upwardly along the vertical axis and against the cap.

12. An appliance having a cooktop, the appliance comprising:

a glass cooktop surface defining a cooktop surface opening;

a heating element positioned at the cooktop surface adjacent to the opening;

a plate defining a top surface and a bottom surface, the plate defining a first annular groove positioned on the top surface of the plate and facing upwardly along a vertical axis, the plate further comprising a boss protruding upwardly along the vertical axis from the top surface of the plate and defining a centrally-located aperture extending through the plate, wherein the boss extends into the cooktop surface opening and defines a second annular groove on a radially outward surface of the boss, the second annular groove facing radially outward from the vertical axis:

a first seal located in the first annular groove of the plate;

a second seal located in the second annular groove, wherein the second seal contacts the glass cooktop surface at the opening;

a grommet disk defining a top surface and a bottom surface, the top surface of the grommet disk engaged with the bottom surface of the plate, the grommet disk defining a cylindrically-shaped grommet extending along the vertical axis from the grommet disk and into the cooktop surface opening, the cylindrically-shaped grommet having a grommet opening; and a cap for a temperature sensor, the cap positioned within the grommet opening, the cap slidable along the vertical axis within the grommet opening, the cap defining an interior space for receipt of a temperature sensor.

13. The appliance having a cooktop as in claim 12, wherein the first annular groove has a first annular groove diameter, the second annular groove has a second annular groove diameter, and the first annular groove diameter is greater than the second annular groove diameter.

14. The appliance having a cooktop as in claim 12, further comprising an interlock extending between the plate and the grommet disk that is configured for holding the plate and the grommet disk together.

15. The appliance having a cooktop as in claim 14, wherein the interlock comprises a pair of flanges extending downwardly along the vertical axis from the bottom surface of the plate towards the grommet disk.

16. The appliance having a cooktop as in claim 15, wherein the grommet disk defines a pair of apertures for receipt of the pair of flanges.

17. The appliance having a cooktop as in claim 12, further comprising a temperature sensor positioned within the cap.

18. The appliance having a cooktop as in claim 12, wherein the grommet comprises a flexible material.

19. The appliance having a cooktop as in claim 12, further comprising:

a piston having a shaft extending along the vertical axis and into the cap; and a spring that urges the piston upwardly along the vertical axis and against the cap.

* * * * *